US006098045A

United States Patent [19]

Yokomizo et al.

[11] Patent Number: 6,098,045

[45] Date of Patent: Aug. 1, 2000

[54] SOUND COMPRESSION/DECOMPRESSION METHOD AND SYSTEM

[75] Inventors: Takashi Yokomizo; Masahiro Serizawa, both of Tokyo, Japan

[73] Assignee: NEC Corporation, Tokyo, Japan

[21] Appl. No.: 09/130,653

[22] Filed: Aug. 7, 1998

[30] Foreign Application Priority Data

Aug. 8, 1997 [JP] Japan ..... 9-227395

[51] Int. Cl.[7] ..... G10L 21/04

[52] U.S. Cl. ..... 704/500; 704/211; 704/215; 704/208

[58] Field of Search ..... 704/214, 215, 704/208, 500

[56] References Cited

U.S. PATENT DOCUMENTS

| | | | |
|---|---|---|---|
| 5,488,704 | 1/1996 | Fujimoto | 704/219 |
| 5,696,875 | 12/1997 | Pan et al. | 704/219 |
| 5,819,212 | 10/1998 | Matsumoto et al. | 704/219 |
| 5,828,996 | 10/1998 | Iijima et al. | 704/220 |
| 5,873,059 | 2/1999 | Iijima et al. | 704/207 |

FOREIGN PATENT DOCUMENTS

| | | |
|---|---|---|
| WO 95/17745 | 6/1995 | WIPO . |
| WO 97/16821 | 5/1997 | WIPO . |

OTHER PUBLICATIONS

M. Serizawa et al., "4kbps Improved Pitch Prediction CELP Speech Coding with 20 msec Frame", IEICE Transactions on Information and Systems, vol. 78–D, No. 6 (Jun. 1995) pp. 758–763.

Oomuro, et al., "PSI–CELP based variable bit rate sound coding", Japan Acoustic Society, Spring–Term Lecture Paper Collection, pp. 309–310, 1994.

Furui, "Digital Sound Processing", Tokai University Publishing, pp. 99–133, Sep. 25, 1985.

*Primary Examiner*—David R. Hudspeth
*Assistant Examiner*—Daniel Abebe
*Attorney, Agent, or Firm*—Foley & Lardner

[57] ABSTRACT

The present invention provides a sound compression/decompression system and method which processes sound data, frame by frame, while transmitting information on special processing at the same time without degrading the bit rate. When a frame for special processing is transmitted in the form of a bit stream, this system sets the index value of the bit stream to a special value not used for normal processing, thus preventing the bit rate from being degraded. This system also contains information on special-processing in the non-index bits of the bit stream to implement various types of special processings. For example, a plurality of consecutive unvoiced frames may be transmitted in a one-frame bit stream.

9 Claims, 19 Drawing Sheets

SOUND COMPRESSION/DECOMPRESSION METHOD AND SYSTEM

FIELD OF THE INVENTION

The present invention relates to a sound compression and decompression method and system, and more particularly to an improvement in the method and system for transmitting information on a special state such as unvoiced sound compression in the sound compression and decompression processing.

BACKGROUND OF THE INVENTION

Conventionally, a system for compressing and decompressing sounds, frame by frame based on certain fixed-time frame, has been based on the Code Excited Linear Prediction (CELP) method. This method is described in "4 kbps Improved Pitch Prediction CELP Speech Coding with 20 msec Frame" by Masahiro SERIZAWA and Kazunori OZAWA, in "IEICE TRANSACTIONS ON INFORMATION AND SYSTEMS, VOL. E78-D, No. 6, June 1995, P758–763.

This sound compression/decompression method changes-over processing according to the type of sound contained in a specified frame in order to increase the quality of compressed and decompressed sounds; for example, it compresses and decompresses voiced sounds and unvoiced sounds separately. To do so, this method selects and sets some specified bits from and within a bit stream to indicate that special processing will be performed and includes data for the special processing into the remaining bits of the bit stream.

The conventional sound compression/decompression system is described below with reference to the drawings. FIG. 16 is a diagram showing the configuration of the conventional sound compression/decompression system. FIG. 17 is a flowchart showing the flow of sound compression processing on the conventional system. FIG. 18 is a flowchart showing the flow of sound decompression processing on the conventional system. FIG. 19 is a diagram showing the overview of one-frame encoded bit stream data processed on the conventional system.

As shown in FIG. 16, the system uses source (original) sound data 103, encoded data 104 generated by a sound compression processing module, and decompressed sound data 105 generated by decompressing the encoded data. The system has a sound compression processing module 106 which compresses sounds, frame by frame, i.e., one frame at a time. This module comprises source sound data reading means 107, a voiced/unvoiced frame checking means 108, a special processing identification bit checking means 109, a voiced sound frame compression means 110, an unvoiced sound frame compression means 111, and an encoded data output means 112. The system also has a sound decompression processing module 113 which decompresses sounds, one frame at a time. The module comprises an encoded data reading means 114, a special processing identification bit checking means 115, a voiced sound frame decompression means 116, an unvoiced sound frame decompression means 117, and a decompressed sound data output means 118.

In the following description, special processing refers to a case of compression/decompression processing performed by compressing and decompressing voiced sounds and unvoiced sounds separately. However, it should be noted that, in the later description of the present invention, special processing is not limited to this processing. For example, the special processing of the present invention includes unvoiced sound compression efficiency enhancement which is achieved by processing voiced sounds and unvoiced sounds separately.

The conventional sound compression/decompression system shown in FIG. 16 is described with reference to the flowcharts shown in FIGS. 17 and 18.

First, by referring to FIG. 16 and FIG. 17, the following explains how the source sound data 103 is compressed.

The sound compression processing module 106 performs the following steps. When the source sound data reading means 107 reads one-frame source sound data in step S37, the voiced/unvoiced frame checking means 108 checks, in step S38, to determine whether the frame is an unvoiced sound frame or a voiced sound frame. If the source sound data is determined to be a voiced sound frame in step S38, control is passed to step S39 where the special processing identification bit checking means 109 sets bit 120 which represents a voiced sound frame. Then, the voiced sound frame compression means 110 compresses the sound data in step S40 and the encoded data output means 112 outputs the encoded data in step S41. FIG. 19 shows a one-frame bit stream consisting of encoded data.

On the other hand, if the source sound data is determined to be an unvoiced sound frame in step S38, control is passed to step S42 where the special processing identification bit checking means 109 sets bit 119 which represents an unvoiced sound frame. Then, the unvoiced sound frame compression means 111 compresses the sound data in step S43 and the encoded data output means 112 outputs the encoded data in step S41.

Next, by referring to FIG. 16 and FIG. 18, the following explains how the sound decompression processing module 113 in the conventional sound compression/decompression system decompresses the encoded data 104 generated in the above compression processing.

The encoded data reading means 114 reads encoded data in step S44, and the special processing identification bit checking means 115 checks which special processing identification bit, shown in FIG. 19, is set: the bit 119 representing a unvoiced sound frame or the bit 120 representing a voiced sound frame. If the bit 120 representing a voiced sound frame is set, control is passed to step S46. The voiced sound frame decompression means 116 decompresses the sound data and, in step S47, the decompressed sound data output means 118 outputs the decompressed sound data.

On the other hand, if the bit 119 representing a voiced sound frame is set, control is passed to step S48. The unvoiced sound frame decompression means 117 decompresses the sound data and, in step S47, the decompressed sound data output means 118 outputs the decompressed sound data.

SUMMARY OF THE DISCLOSURE

However, in the course of the investigations toward the present invention the following problems have been encountered. Namely, the conventional sound compression/decompression system explained above using FIG. 16 to FIG. 19 has the following problems:

The first problem is that special processing requires higher bit rates. Therefore, a need to implement special processing a plurality of times results in significantly high bit rates.

This is because each special processing performed in the conventional sound compression/decompression system requires an additional bit.

The second problem is that in some processing systems, data are required to be processed, byte by byte, i.e., one byte at a time, for processing efficiency reason. In this case, even an additional one bit results in an additional one byte, adversely affecting the compression efficiency to a significant extent.

Therefore, the present invention seeks to solve the problems associated with the prior art described above. It is an object of the present invention to provide a novel sound compression/decompression system and method which implement special processing without adversely affecting compression efficiency.

Further objects of the present invention will become apparent in the entire disclosure.

To achieve the above objects, there is provided a sound compression/decompression system which compresses and decompresses sounds, frame by frame, according to one aspect of the present invention. The system comprises a sound compression processing module which, for a frame for which special processing is performed, sets to a special state an index within a bit stream to be transmitted by the frame and transmits the frame for which the special processing is performed; and a sound decompression processing module which references the index set (stored) within the bit stream and performs the special processing.

According to a second aspect of the present invention, there is provided a sound compression/decompression system which compresses and decompresses sounds, frame by frame. The system comprises a sound compression processing module which, for a frame for which special processing is performed, sets to a special state an index within a bit stream to be transmitted by the frame, stores information necessary for the special processing into non-index bits, and transmits the frame for which the special processing is performed; and a sound decompression processing module which references the index within the bit stream to identify that the special processing is performed for the frame, gets information necessary for the special processing from the non-index bits within the bit stream, and performs the special processing.

According to a third aspect of the present invention, there is provided a sound compression/decompression system which compresses and decompresses sounds, frame by frame. The system comprises a sound compression processing module which, for a frame for which special processing is performed, sets to a special state an index within a bit stream to be transmitted by the frame and transmits only the index bits; and a sound decompression processing module which references the index within the bit stream to identify that the special processing is performed for the frame and performs the special processing.

In a fourth aspect of the present invention, there is provided a sound compression/decompression method of compressing and decompressing sounds, frame by frame. The method comprises the steps of performing sound compression processing in which, for a frame for which special processing is performed, an index within a bit stream to be transmitted by the frame is set to a special state and the frame for which the special processing is performed is transmitted; and performing decompression processing in which the index set (stored) within the bit stream is referenced and the special processing is performed.

In a further aspect, the system or method, in which, for the frame for which the special processing is performed, the sound compression module sets the index within the bit stream transmitted by the frame to a value not used during normal compression operation.

Other aspects of the present invention will become apparent in the entire disclosure.

DETAILED DESCRIPTION OF THE PREFERRED EMBODIMENTS

Some embodiments of the present invention are described below with reference to the drawings.

First Preferred Mode

Figure 1:
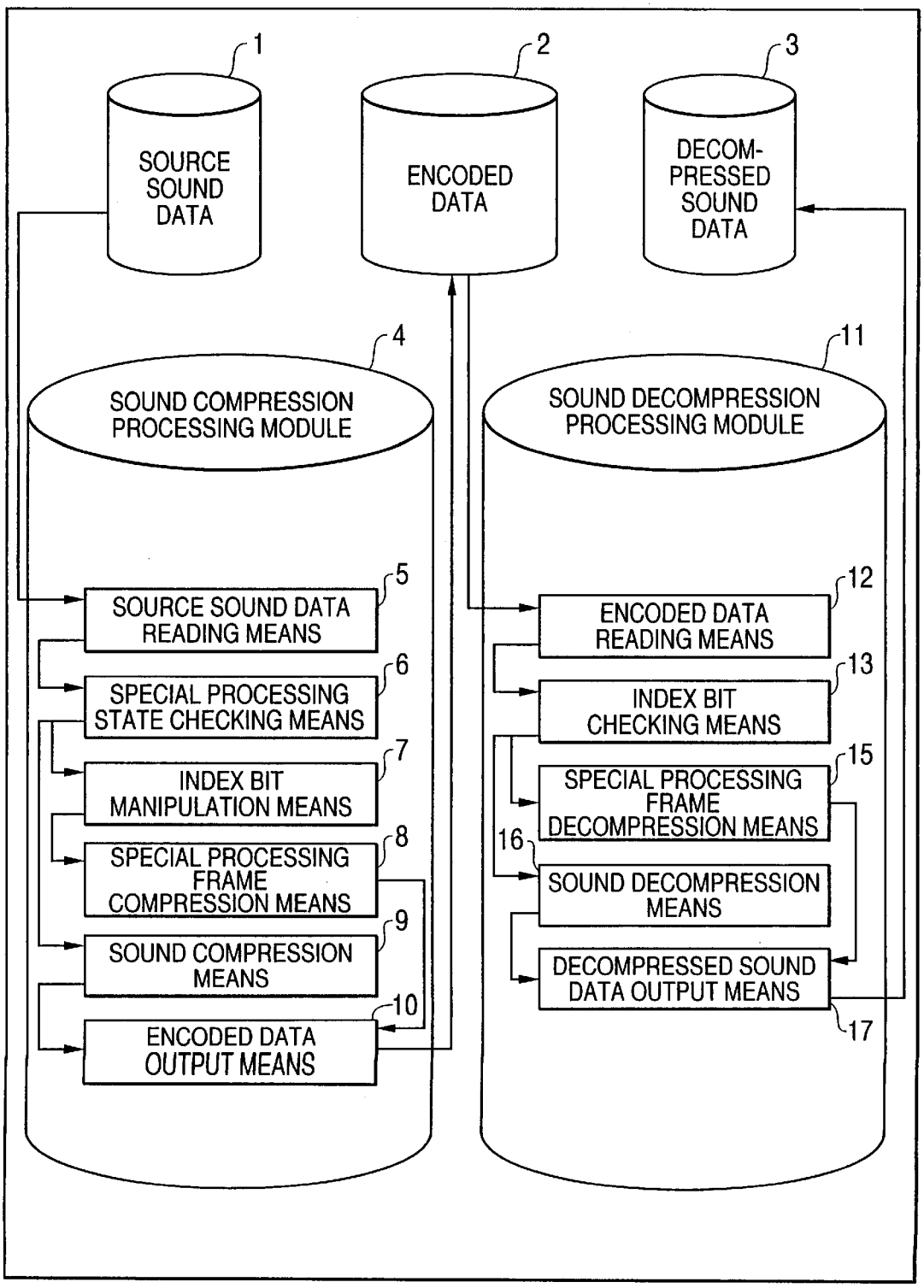
FIG. 1 is a diagram showing the configuration of a first preferred mode.

FIG. 1 is a diagram showing the configuration of a first preferred mode of the present invention. As shown in FIG. 1, a sound compression/decompression system of the present invention in the first preferred mode comprises a sound compression processing module 4 and a sound decompression processing module 11. The sound compression processing module 4 comprises source (original) sound data reading means 5, a special processing state checking (discriminating) means 6, an index bit manipulation means 7, a special processing frame compression means 8, a sound compression means 9, and an encoded data output means 10.

The sound decompression processing module 11 comprises an encoded data reading means 12, an index bit checking (discriminating) means 13, a special processing frame decompression means 15, a sound decompression means 16, and a decompressed sound data output means 17.

Source sound data 1 to be compressed is read by the source sound data reading means 5 into the sound compression processing module 4 and then into the special processing state checking means 6. The special processing state checking means 6 checks if special processing is to be performed on the entered source sound data in the sound compression processing module 4.

If the special processing state checking means 6 finds that special processing is to be performed on the entered source sound data, the index bit manipulation means 7 sets the index bit value to a value assigned to special processing. The special processing frame compression means 8 compresses the sound data, and the encoded data output means 10 outputs the generated encoded data. The "index" refers to a bit string containing values necessary for sound data compression/decompression, such as a value representing an LSP (Linear Spectrum Pair) coefficient used in the CELP method. In a case where the value of the index bits is fixed or in a limited range, a value which may be represented by the index bits but which is never used during normal processing is assigned to a special processing state.

On the other hand, if the special processing state checking means 6 finds that special processing is not to be performed on the entered source sound data, the sound compression means 9 compresses the sound data, and the encoded data output means 10 outputs generated encoded data 2.

To decompress the generated encoded data 2, the encoded data reading means 12 reads the encoded data into the sound decompression processing module 11. Then, the index bit checking means 13 checks if the index bits of the entered encoded data contain a value assigned to special processing. If the index bit checking means 13 finds that special processing is to be performed on the encoded data, the special processing frame decompression means 15 decompresses the special processing frame and the decompressed sound data output means 17 outputs the decompressed sound data.

If the index bit checking means 13 finds that special processing is not to be performed on the entered encoded data, the sound decompression means 16 decompresses the encoded sound data and the decompressed sound data output means 17 outputs the decompressed sound data.

As described above, the first preferred mode of the present invention does not require additional bits to implement special processing. Instead, by assigning an index level to a special processing state, information on special processing may be transmitted without degrading the bit rate.

First Embodiment

Figure 2:
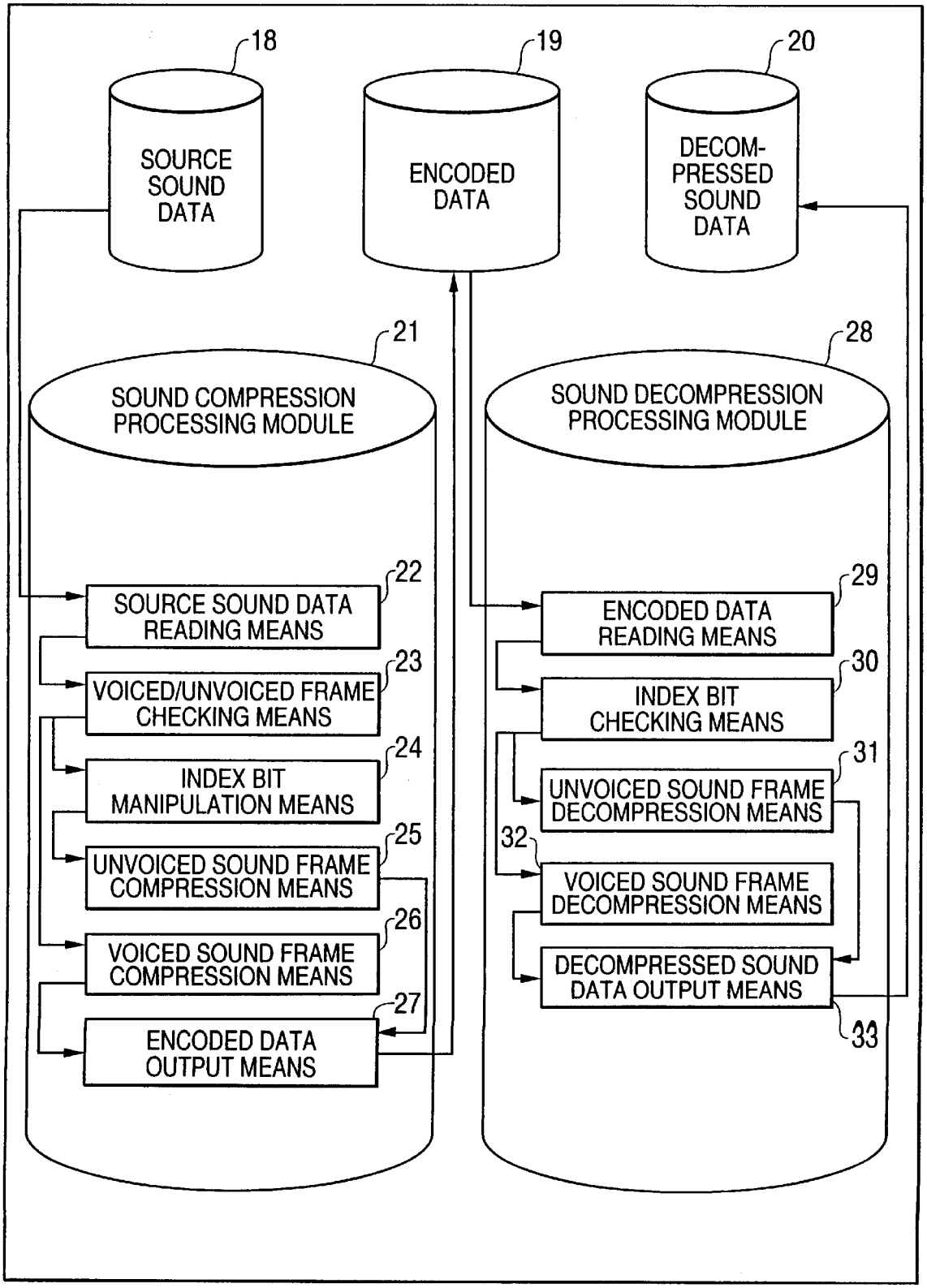
FIG. 2 is a diagram showing the configuration of a first embodiment.
Figure 3:
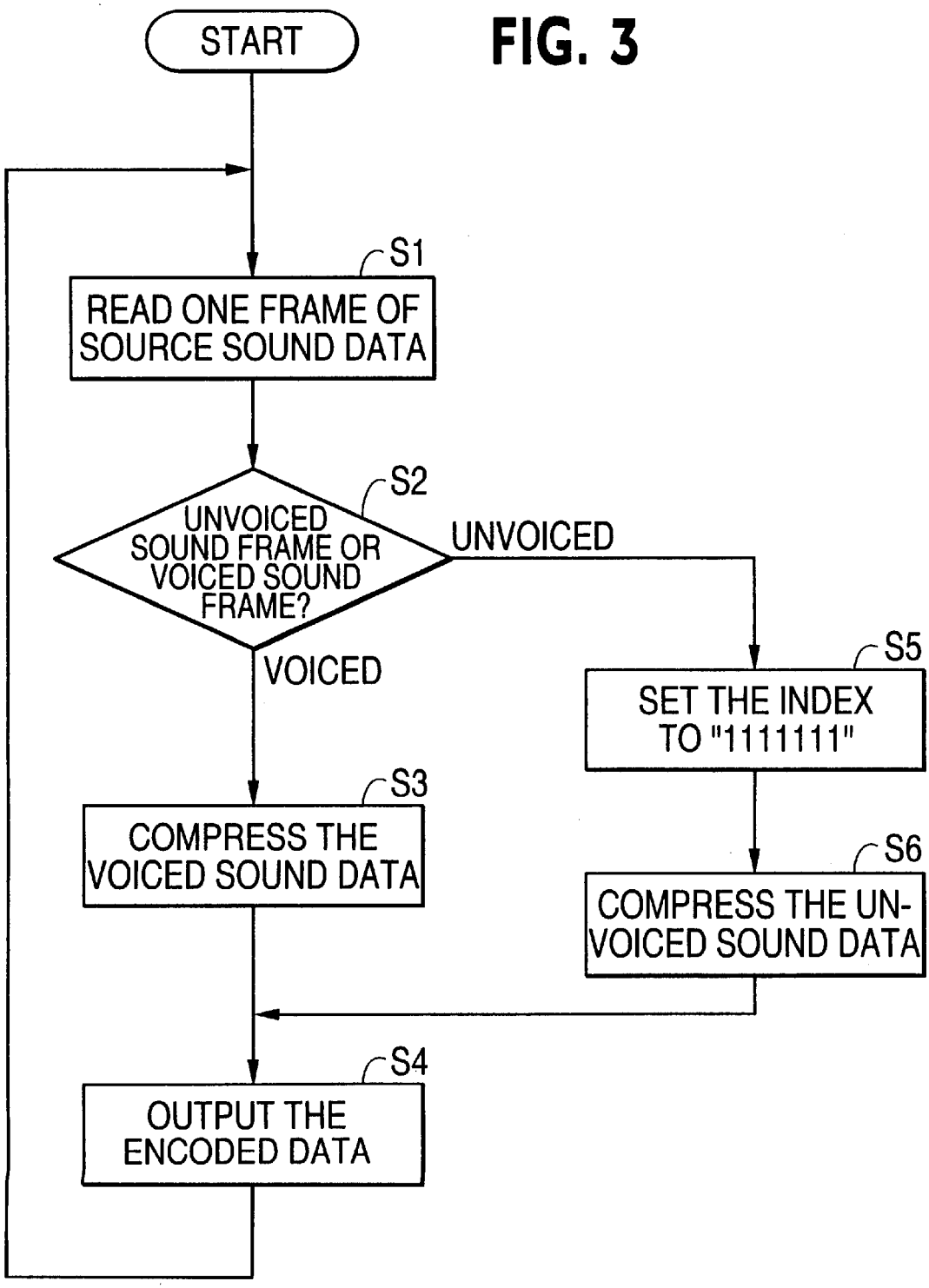
FIG. 3 is a flowchart showing the flow of sound compression processing in the first embodiment.
Figure 4:
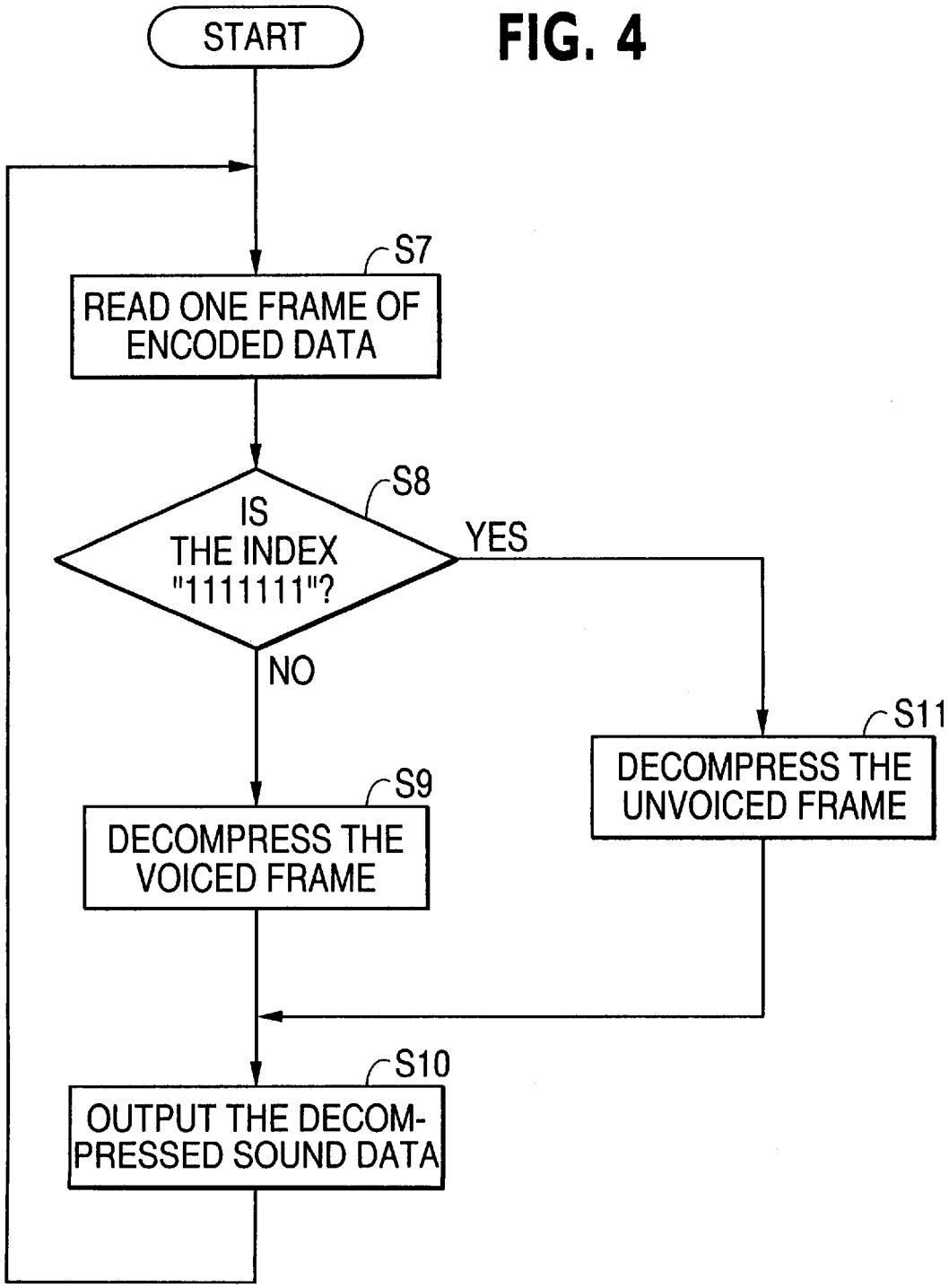
FIG. 4 is a flowchart showing the flow of sound decompression processing in the first embodiment.
Figure 5:
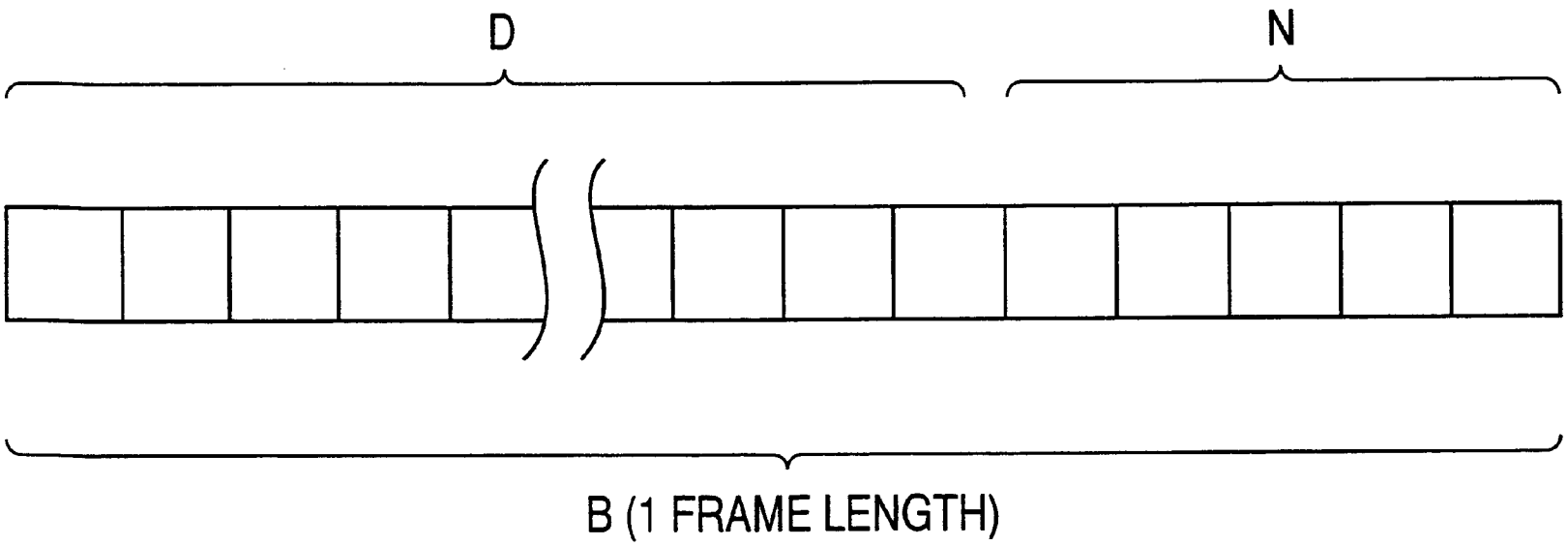
FIG. 5 is a diagram showing a bit stream of encoded data used in the first embodiment.

To explain the above-described preferred mode more in detail, a first embodiment of the present invention is described below. FIG. 2 is a diagram showing the configuration of the first embodiment of the present invention. FIG. 3 is a flowchart showing the flow of sound data compression processing that is performed in the first embodiment of the present invention. FIG. 4 is a flowchart showing the flow of sound data decompression processing that is performed in the first embodiment of the present invention. FIG. 5 is an overview of a bit stream for one-frame encoded data used in the first embodiment of the present invention.

The sound data compression/decompression system used in the first embodiment of the present invention assumes the unvoiced (silent) state as the special processing state. As described above, FIG. 5 shows the bit stream for one-frame encoded data, where N represents the index. In the first embodiment of the present invention, a 7-bit string containing CELP LSP coefficients is assumed. The value of '1111111', which is never used during normal compression operation, is assigned as the value for an unvoiced frame.

In FIG. 2, number 18 refers to source (original) sound data to be compressed, number 19 refers to encoded data compressed by a sound compression processing module, number 20 refers to decompressed sound data decompressed by a sound decompression processing module, number 21 refers to the sound compression processing module which compresses sounds using the CELP method described in the above-mentioned document 1, number 22 refers to source sound data reading means, number 23 refers to voiced/unvoiced frame checking means, number 24 refers to index bit manipulation means, number 25 refers to unvoiced sound frame compression means, and number 26 refers to voiced sound frame compression means, number 27 refers to an encoded data output means. Number 28 refers to the sound decompression processing module, number 29 refers to encoded data reading means, number 30 refers to index bit checking means, number 31 refers to unvoiced sound frame decompression means, number 32 refers to voiced sound frame decompression means, and number 33 refers to decompressed sound data output means.

By referring to FIG. 2 and FIG. 3, the following describes sound compression processing performed in the first embodiment.

First, in step S1, the source sound data reading means 22 reads one frame of source sound data 18 entered into the sound compression processing module 21.

Next, in step S2, the voiced/unvoiced frame checking means 23 checks whether the entered sound is a voiced frame or an unvoiced frame. If the voiced/unvoiced frame checking means 23 finds that the entered source sound data is a voiced frame, control is passed to step S3. Then, the voiced sound frame compression means 26 compresses the sound data and, in step S4, the encoded data output means 27 outputs the encoded data.

On the other hand, if the voiced/unvoiced frame checking means 23 finds that the source sound data is an unvoiced frame in step S2, control is passed to step S5. Then, the index bit manipulation means 24 sets the index bits N to '1111111' which is assigned to the unvoiced frame. In step S6, the unvoiced sound frame compression means 25 compresses the sound data and, in step S4, the encoded data output means 27 outputs the encoded data.

Next, by referring to FIG. 2 and FIG. 4, the following describes how the encoded data, compressed as described above, is decompressed.

First, in step S7, the encoded data reading means 29 reads the encoded data and, in step S8, the index bit checking means 30 checks whether the index bits N are '1111111'.

If the index bit checking means 30 finds that the index bits N are not '1111111' in step S8, the frame is a voiced frame. In this case, the voiced sound frame decompression means 32 decompresses the sound data in step S9 and, in step S10, the decompressed voiced data is output.

On the other hand, if the index bit checking means 30 finds that the index bits are '1111111' in step S8, the frame is an unvoiced frame. In this case, the unvoiced sound frame decompression means 31 decompresses the sound data in step S11 and, in step S10, the decompressed sound data is output.

Second Preferred Mode

Figure 6:
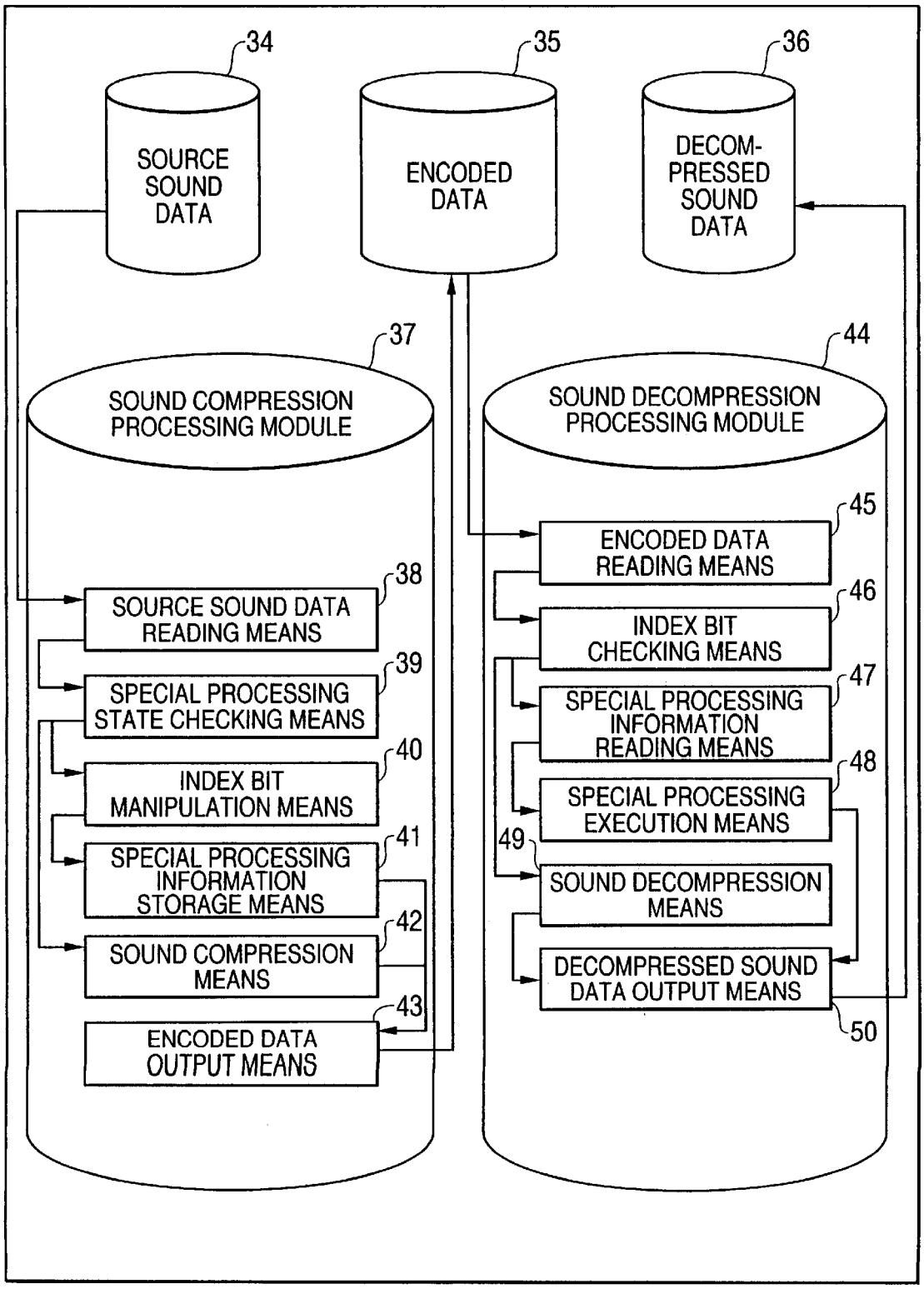
FIG. 6 is a diagram showing the configuration of a second preferred mode.

A second preferred mode of the present invention is described. FIG. 6 is a diagram showing the configuration of the second preferred mode of the present invention.

As shown in FIG. 6, source sound data 34 to be compressed is read by a source sound data reading means 38 into a sound compression processing module 37 as in the first preferred mode. Then, a special processing state checking means 39 checks whether special processing is to be performed on the source sound data that was read. If the special processing state checking means 39 finds that the special processing is to be performed, an index bit manipulation means 40 sets the index bits to a value assigned to the special processing, a special processing information storage means 41 records special processing information into the non-index bits of the bit stream. Then, encoded data output means 43 outputs the generated encoded data.

If the special processing state checking means 39 finds that the special processing is not to be performed on the entered source sound data, a sound compression means 42 compresses the sound data as usual and the encoded data output means 43 outputs the generated encoded data.

To decompress the generated encoded data 35, encoded data reading means 45 reads encoded data 35 as in the first preferred mode and index bit checking means 46 checks whether the index bits of the entered encoded data contains a value to the special processing.

If the index bit checking means 46 finds that the index bits of the entered encoded data contains a value representing the special processing, a special processing information reading means 47 reads special processing information from the non-index bits of the encoded data and a special processing execution means 48 performs the special processing.

If the index bit checking means 46 finds that the special processing is not to be performed on the entered encoded data, a sound decompression means 49 decompresses the sound data as usual and the decompressed sound data output means 50 outputs decompressed sound data.

As mentioned, the second preferred mode of the present invention does not require additional bits for special processing but assigns a special index value to the special processing. This allows information on special processing to be transmitted without degrading the bit rate.

In addition, this preferred mode allows information on a special processing implementaton to be stored in the non-index bits of the bit stream, enabling various types of special processing to be implemented.

Second Embodiment

To explain the above-described second preferred mode in more detail, a second embodiment of the present invention is described below.

Figure 7:
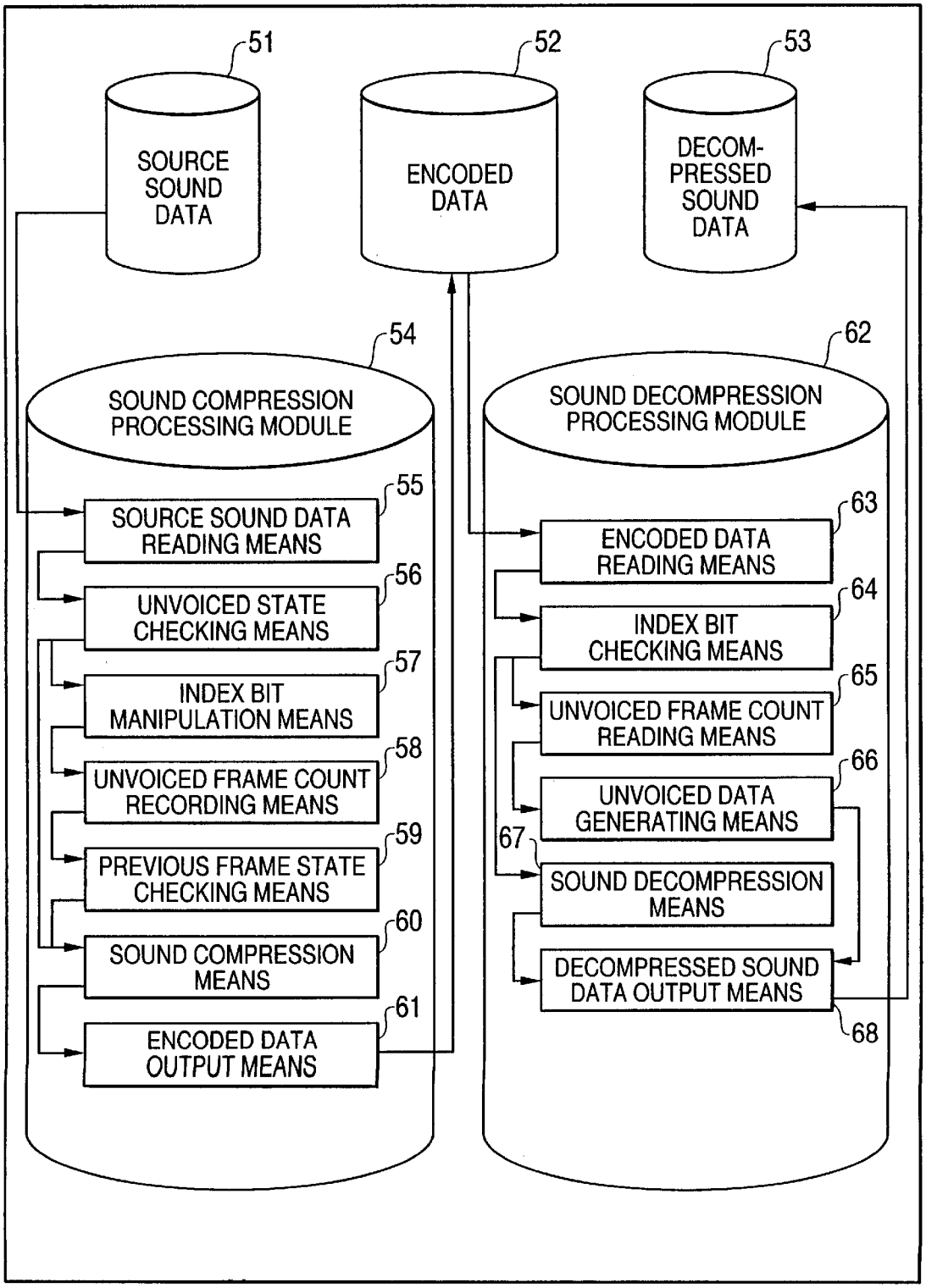
FIG. 7 is a diagram showing the configuration of a second embodiment.
Figure 8:
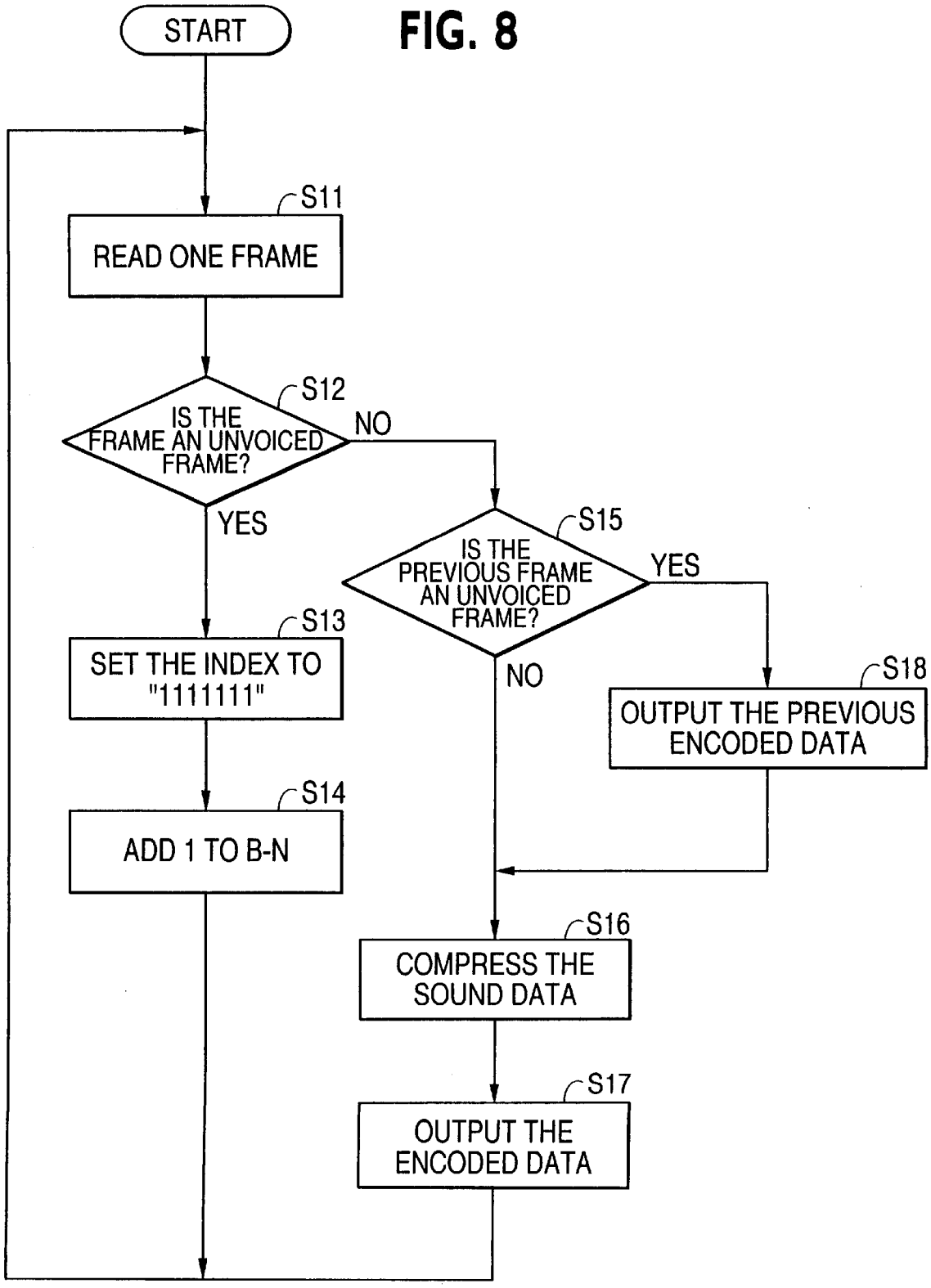
FIG. 8 is a flowchart showing the flow of sound compression processing in the second embodiment.
Figure 9:
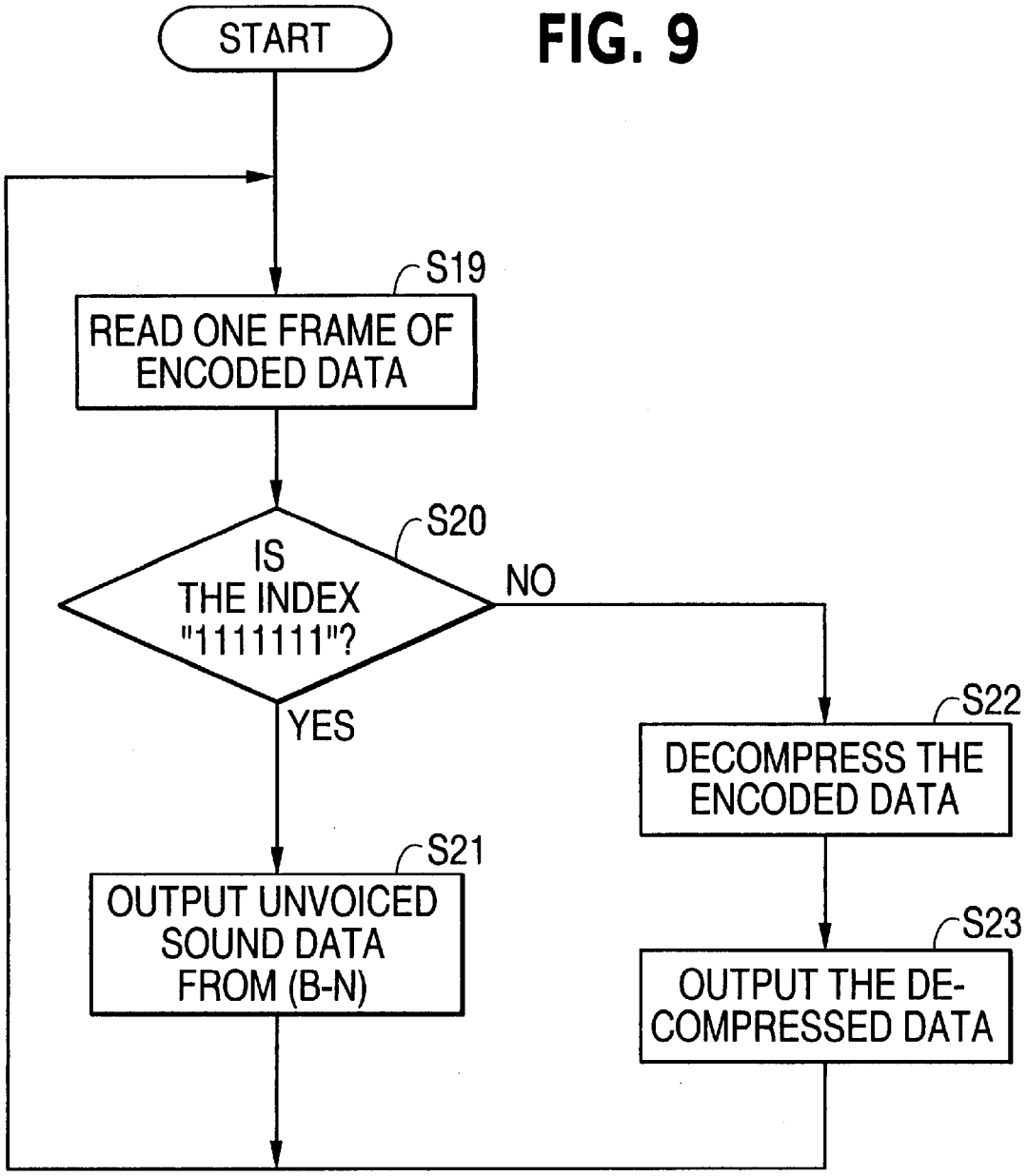
FIG. 9 is a flowchart showing the flow of sound decompression processing in the second embodiment.
Figure 10:
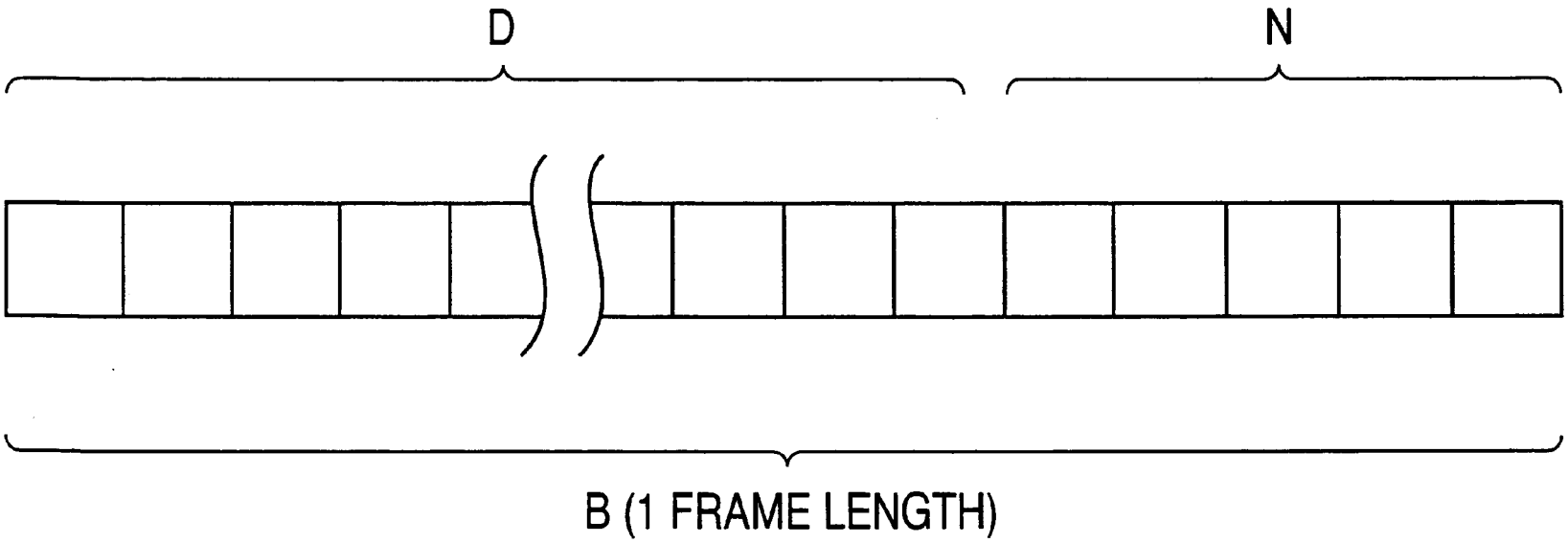
FIG. 10 is a diagram showing a bit stream of encoded data used in the second embodiment.

FIG. 7 is a diagram showing the configuration of the second embodiment of the present invention. FIG. 8 is a flowchart showing the flow of sound data compression processing that is performed in the second embodiment of the present invention. FIG. 9 is a flowchart showing the flow of sound data decompression processing that is performed in the second embodiment of the present invention. FIG. 10 is an overview of a bit stream for one-frame encoded data used in the second embodiment of the present invention.

In FIG. 7, number 51 refers to source sound data, number 52 refers to encoded data compressed by a sound compression processing module, and number 53 refers to decompressed sound data decompressed by a sound decompression processing module. Number 54 refers to the sound compression processing module, number 55 refers to a source sound data reading means, number 56 refers to unvoiced state checking means, number 57 refers to index bit manipulation means, number 58 refers to unvoiced frame count recording means, number 59 refers to previous frame state referencing means, number 60 refers to sound compression means according to the CELP method explained in the first preferred mode, and number 61 refers to encoded data output means. Number 62 refers to the sound decompression processing module, wherein number 63 refers to encoded data reading means, number 64 refers to index bit checking means, number 65 refers to unvoiced frame count reading means, number 66 refers to unvoiced data generating means, number 67 refers to sound decompression means according to the CELP method explained in the first preferred mode, and number 68 refers to decompressed sound data output means.

The sound compression/decompression system in the second embodiment of the present invention assumes the unvoiced state as the special processing state. FIG. 10 shows a bit stream for one-frame encoded data stream used in the second embodiment of the present invention. N represents the index. In the second embodiment of the present invention, the value of N, from '1011111' to '1111111', is not used for normal compression but is used to define the special state. One of the values in this range, '11111111', is assigned to unvoiced sound compression.

In addition, the non-index part D of the bit stream contains the number of unvoiced frames.

By referring to the flowcharts in FIG. 7, FIG. 8, and FIG. 9, the following describes how sounds are compressed and decompressed by the sound compression/decompression system used in the second embodiment of the present invention.

In the description of the second embodiment of the present invention, it is assumed that the source sound data is entered in the following sequence: a voiced frame containing sound data, an unvoiced frame containing no sound data, an unvoiced frame, a voiced frame, and so forth.

First, in step S11, the source sound data reading means 55 reads one frame of source sound data 51. Next, in step S12, the unvoiced state checking means 56 checks if the entered sound is an unvoiced frame. To do so, the unvoiced state checking means 56 checks the power of the entered sound. If the power of this sound is larger than a predetermined value, the frame is treated as a voiced frame; otherwise, the frame is treated as an unvoiced frame.

Because the first frame is a voiced frame in this example, control is passed to step S15 and the previous frame state checking means 59 checks if the previous frame is an unvoiced frame. In this case, control is passed to step S16 because the first frame is being processed. The sound compression means 60 compresses the sound data and, in step S17, the encoded data output means 61 outputs the encoded data.

Control goes back to step S11 to read the source sound data of the second frame. Control is then passed to step S12, and the check is made to see if the frame is a voiced frame or an unvoiced frame. Because the second frame is an unvoiced frame in this example, control is passed to step S13. In this step, the index bit manipulation means 57 sets the index N of the bit stream, shown in FIG. 10, to '1111111' to define unvoiced compression.

Next, control is passed to step S14, where the unvoiced frame count recording means 58 stores the number of unvoiced frames (1 in this case) in the non-index part, D, of the bit stream.

Control goes back to S11 again to read the source sound data of the third frame. In step S12, the check is made to see if the frame is an unvoiced frame. Because the third frame is an unvoiced frame in this example, control is passed to step S13 and the index N of the bit stream, shown in FIG. 10, is set to '1111111' which is defined as unvoiced compression. Control is then passed to step S14, and the number of unvoiced frames, 1, is added to the non-index part D.

Control goes back to step S11 again to read the source sound data of the fourth frame. Next, control is passed to step S12 to check if the frame is an unvoiced frame or a voiced frame. Because the fourth frame is a voiced frame in this example, control is passed to step S15 to check if the previous frame is an unvoiced frame. Because the third frame is an unvoiced frame in this example, control is passed to step S18 to output the generated encoded data of the unvoiced frame. In step S16, the fourth frame is compressed and, in step S17, the encoded data is output.

For the fifth frame, the source sound data is read in step S11 and, in step S12, the check is made to see if the frame is a voiced frame or an unvoiced frame. Because the fifth frame is a voiced frame in this example, control is passed to step S15 to check if the previous frame is an unvoiced frame. Because the fourth frame is a voiced frame in this example, control is passed to step S16 where the sound data is compressed. In step S17, the encoded data is output.

Next, by referring to FIG. 7 and FIG. 9, the following explains how the encoded data compressed in the sequence described above (voiced frame→unvoiced frame→unvoiced frame→voiced frame→voiced frame) is decompressed.

First, the encoded data reading means 63 reads the first frame of encoded data in step S19, and the index bit checking means 64 checks if the N bits contain '1111111'. Because the first frame is a voiced frame in this example, control is passed to step S22. Then, the sound decompression means 67 decodes the encoded data, and the decompressed sound data output means 68 outputs the decoded sound data.

Control goes back to step S19, and the second frame of encoded data is read. The check is made in step S20 to see if the index N bits of the encoded data contain '1111111'. Because the second frame is an unvoiced frame and the N bits contain '1111111' in this example, control is passed to step S21. Then, the unvoiced frame count reading means 65 reads a value from the D bits of the encoded data, the unvoiced data generating means 66 generates unvoiced sound data corresponding to the value, and the decompressed sound data output means 68 outputs the generated unvoiced sound data. Because the second frame and the third frame, which are two consecutive unvoiced frames, were compressed into one frame of data compressed in the compression processing described above and because '2' is stored in D, two frames of unvoiced sound data corresponding to the second and third frames are output as decompressed sound data. Control goes back to step S19, and the fourth frame of encoded data is read. Because the fourth frame is a voiced frame in this example, the check is made in step S20 and control is passed to step S22. The encoded data is decompressed, and the decompressed sound data is output in step S23. The fifth frame, the last frame which contains voiced data, is processed in the same way as the fourth frame was processed.

Third Preferred Mode

Figure 11:
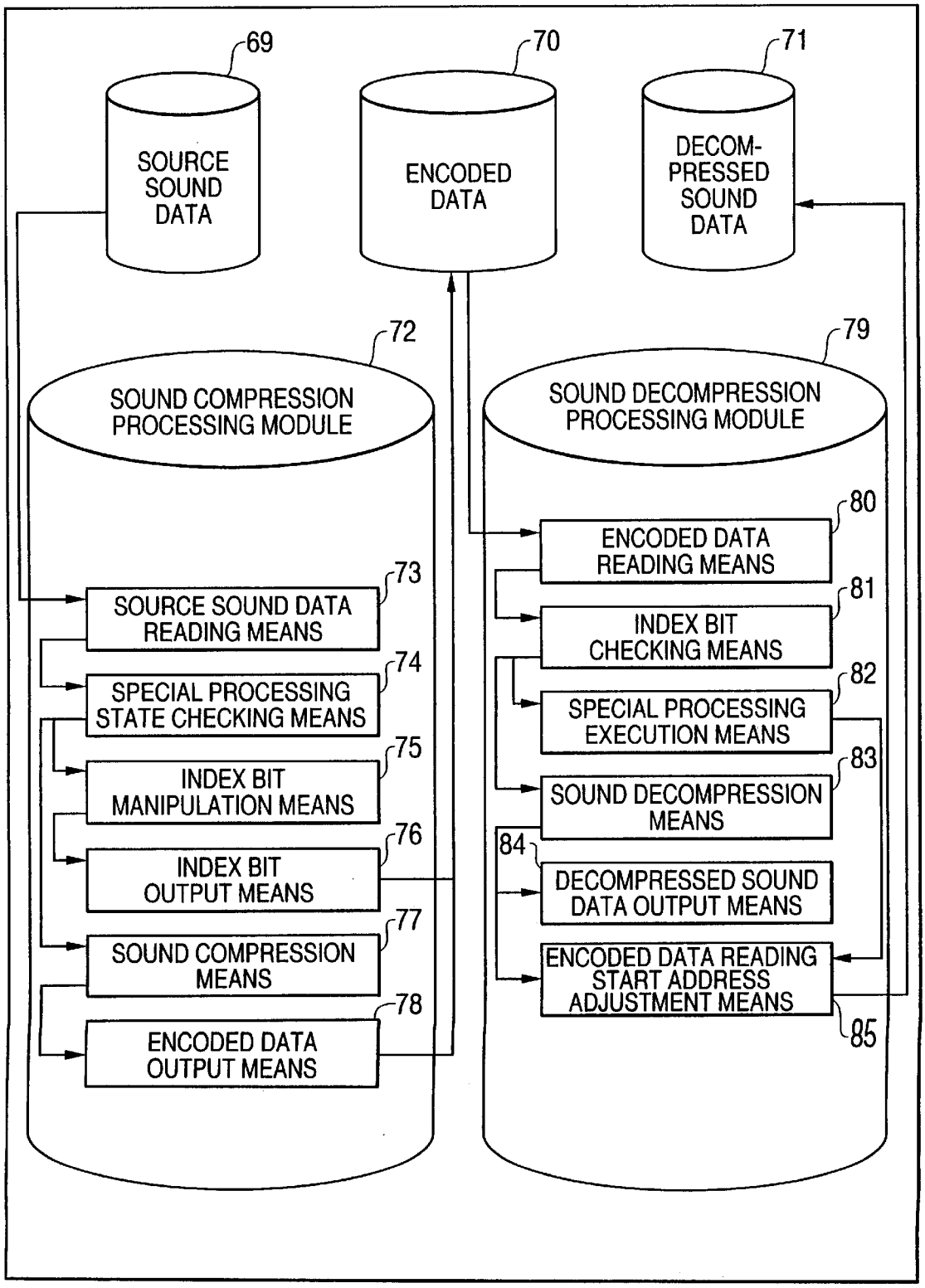
FIG. 11 is a diagram showing the configuration of a third preferred mode.

A third preferred mode is described. FIG. 11 is a diagram showing the configuration of the third preferred mode of the present invention.

The source sound data reading means 73 reads source sound data 69, which is to be compressed, into a sound compression processing module 72. The source sound data is then passed to special processing state checking means 74. The special processing state checking means 74 checks if special processing is to be performed on the entered source sound data. If the module finds that the special processing is to be performed, index bit manipulation means 75 sets the index bit value to a value assigned to the special processing. Then, index bit output means 76 outputs only the index bits.

If the special processing state checking means 74 finds that the special processing is not to be performed, sound compression means 77 compresses the sound data, and encoded data output means 78 outputs encoded data 70.

To decompress the generated encoded data 70, encoded data reading means 80 first reads the encoded data into a sound decompression processing module 79. Index bit checking means 81 in the module checks the index bits of the entered encoded data to see if the index bits contain a value representing the special processing. If the index bit checking means 81 finds that the index bits contain a value representing the special processing, special processing execution means 82 performs the special processing. Then, encoded data reading start address adjustment means 85 increments the next-frame read start address by the number of index bits.

If the index bit checking means 81 finds that the special processing is not to be performed on the entered encoded data, sound decompression means 83 decompresses the sound data, decompressed sound data output means 84 outputs the decompressed data, and the encoded data reading start address adjustment means 85 increments the next-frame read start address by the number of bits of the one-frame encoded data.

As mentioned, this preferred mode of the present invention makes the number of bits variable by decreasing the number of bits during the special processing, thus reducing the number of bits that must be processed.

Third embodiment

Figure 12:
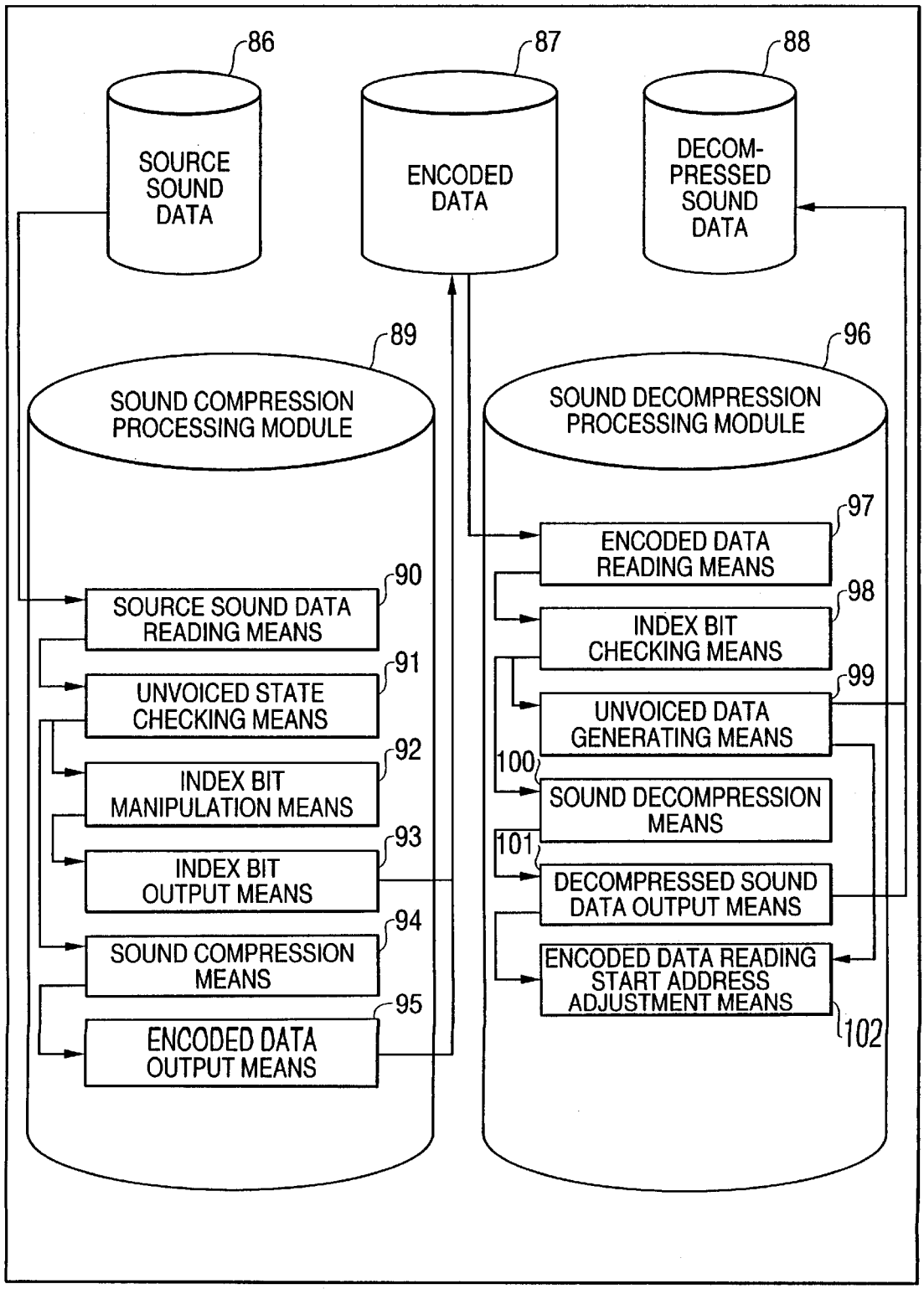
FIG. 12 is a diagram showing the configuration of a third embodiment.
Figure 13:
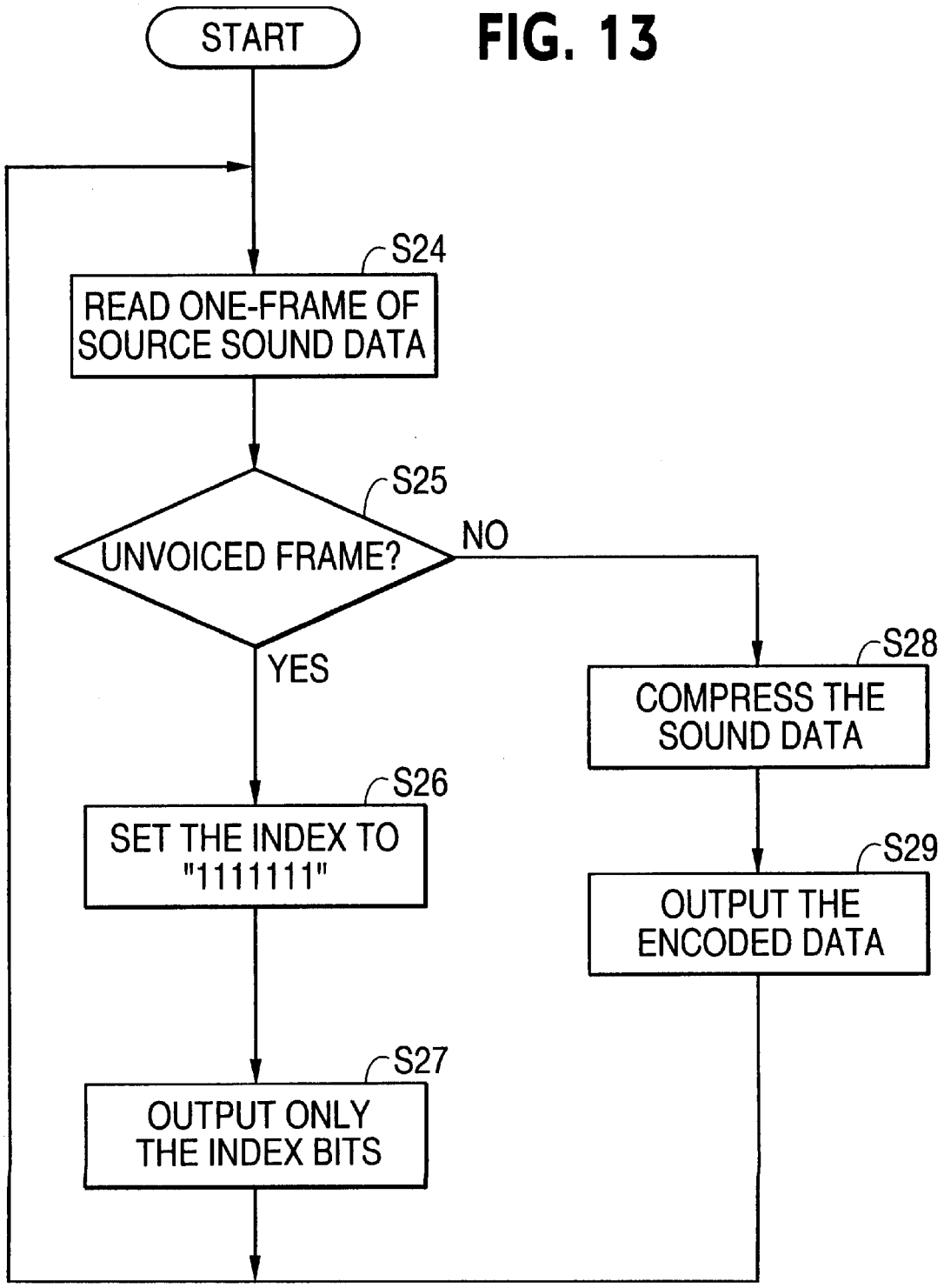
FIG. 13 is a flowchart showing the flow of sound compression processing in the third embodiment.
Figure 14:
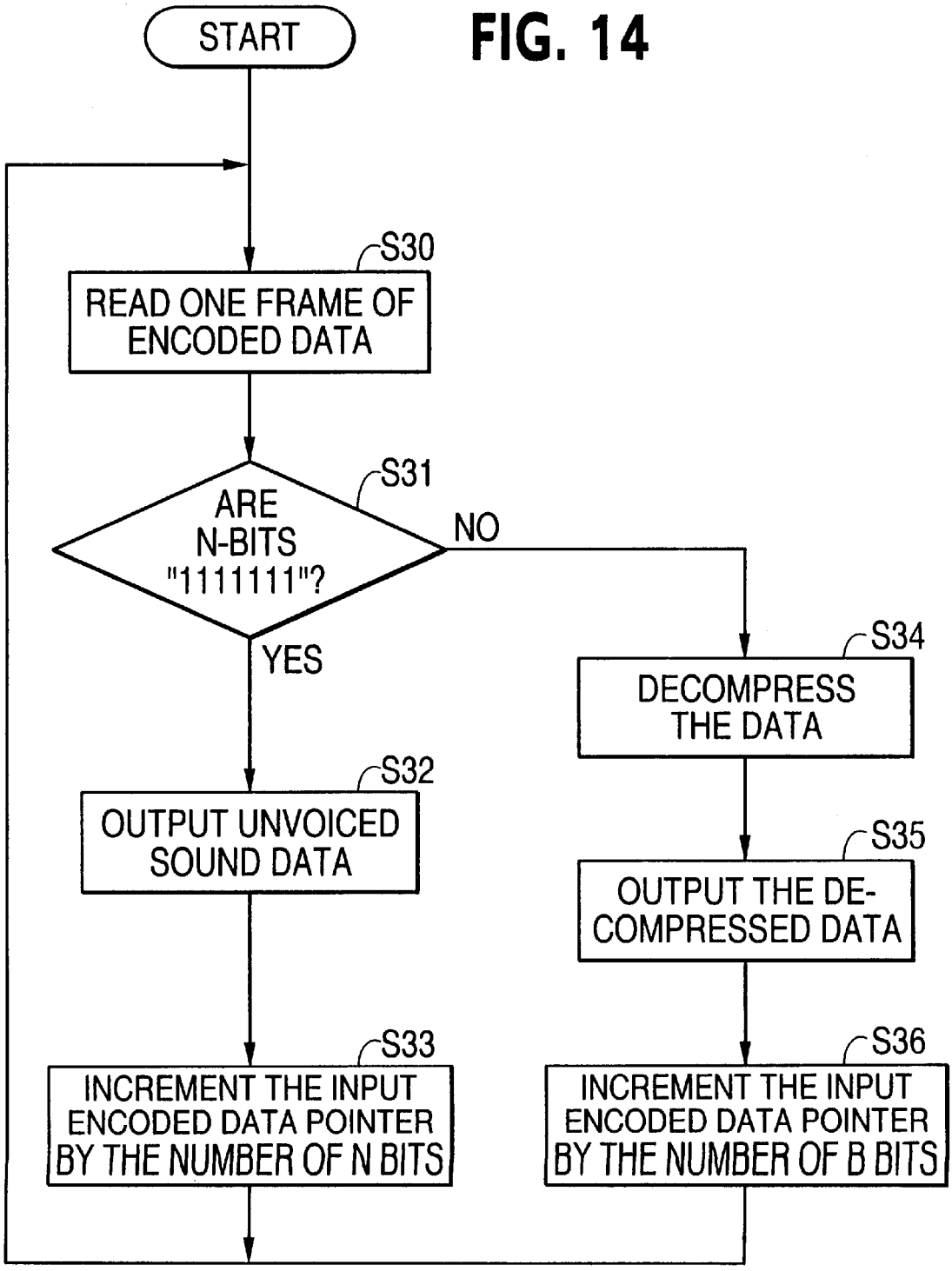
FIG. 14 is a flowchart showing the flow of sound decompression processing in the third embodiment.
Figure 15:
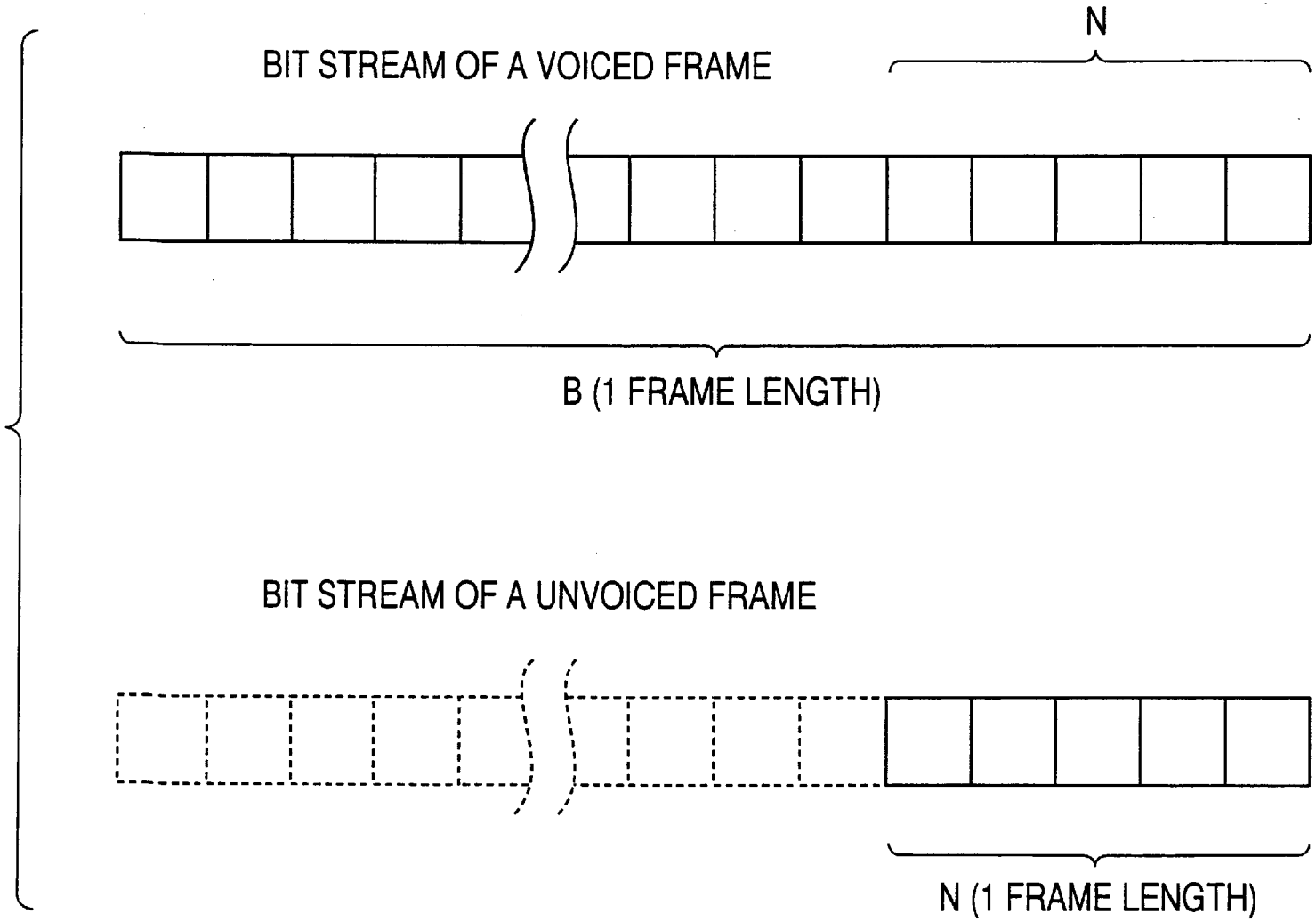
FIG. 15 is a diagram showing a bit stream of encoded data used in the third embodiment.
Figure 16:
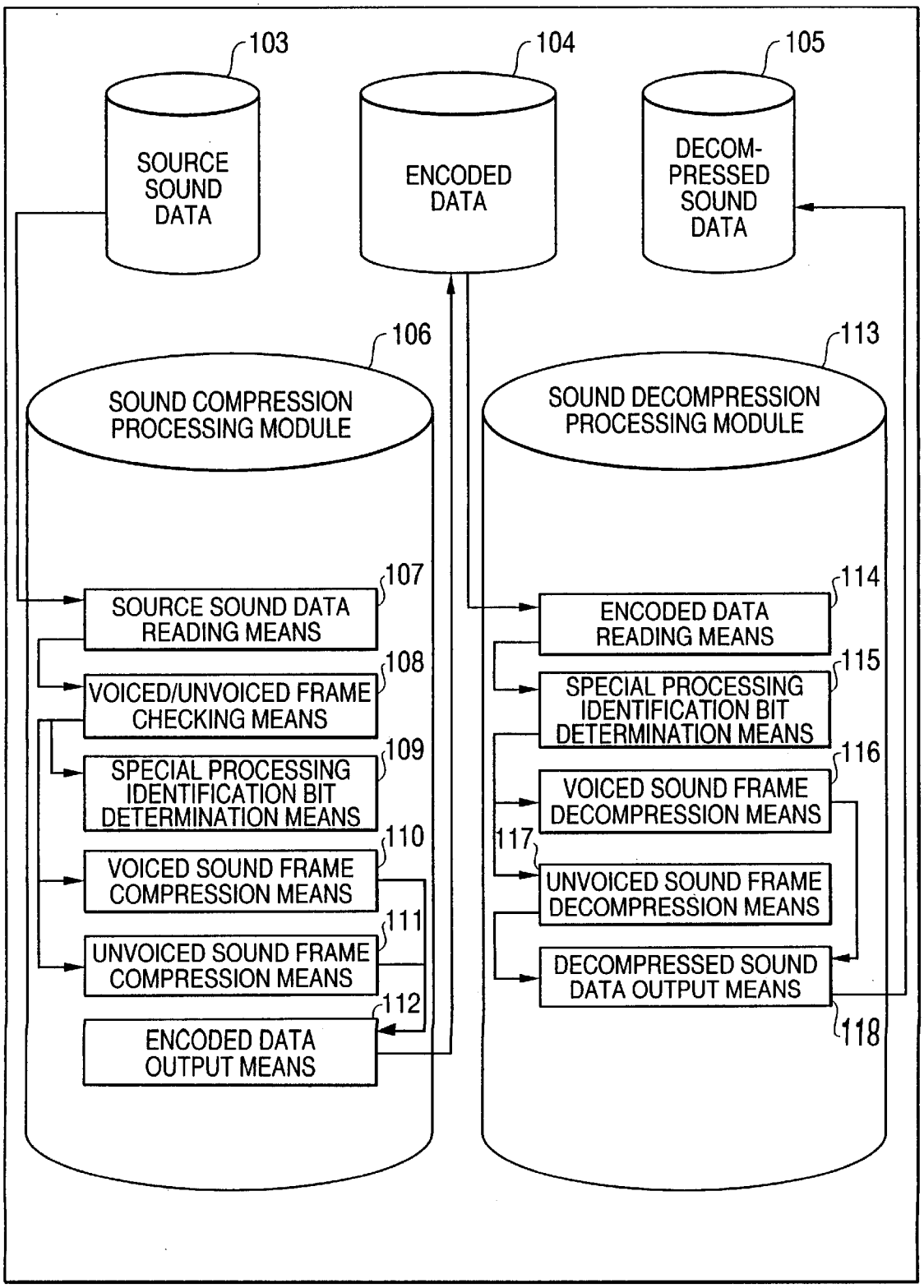
FIG. 16 (PRIOR ART)
FIG. 16 is a diagram showing an example of the configuration of a conventional sound compression/decompression system.
Figure 17:
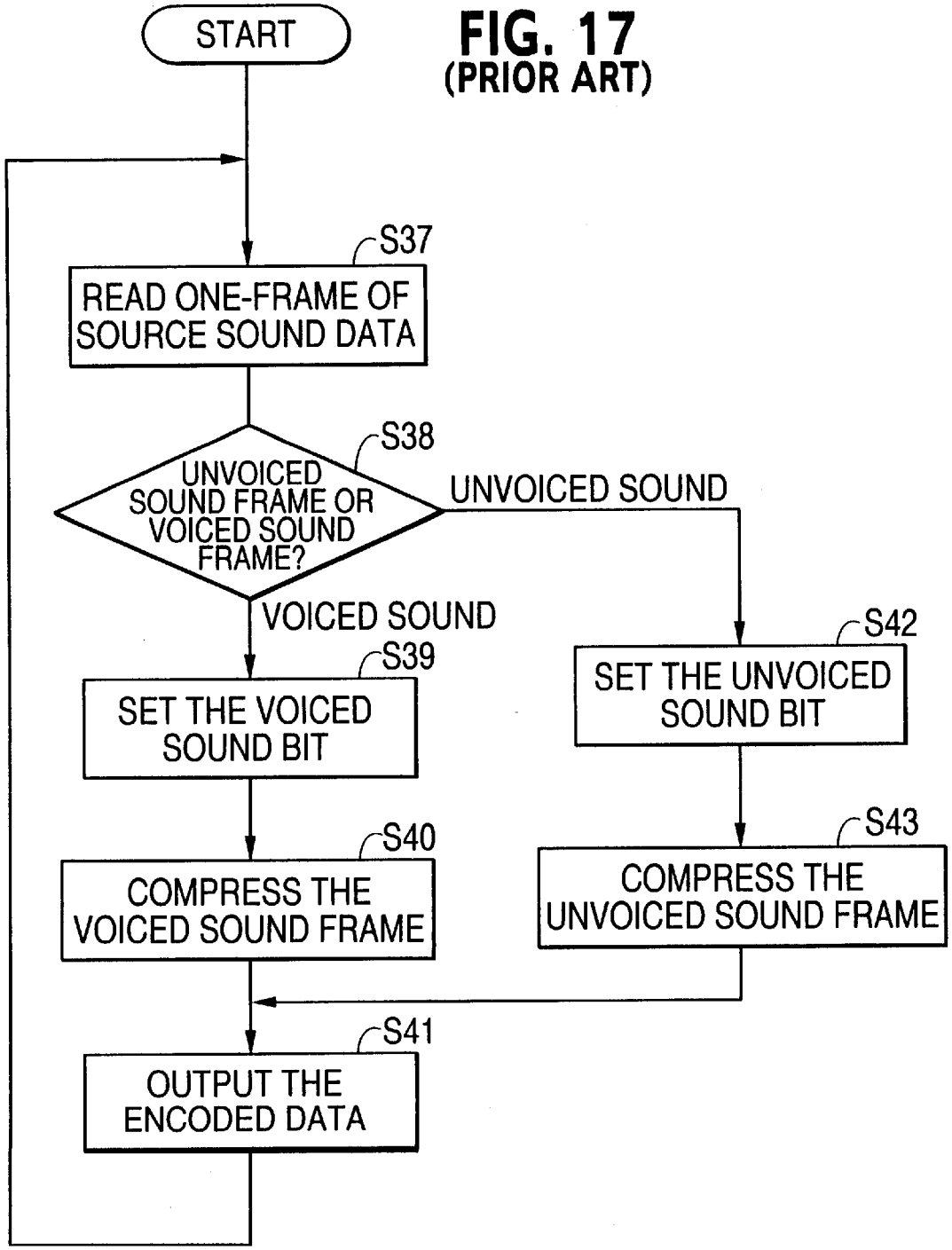
FIG. 17 (PRIOR ART)
FIG. 17 is a flowchart showing the flow of sound compression processing in the conventional sound compression/decompression system.
Figure 18:
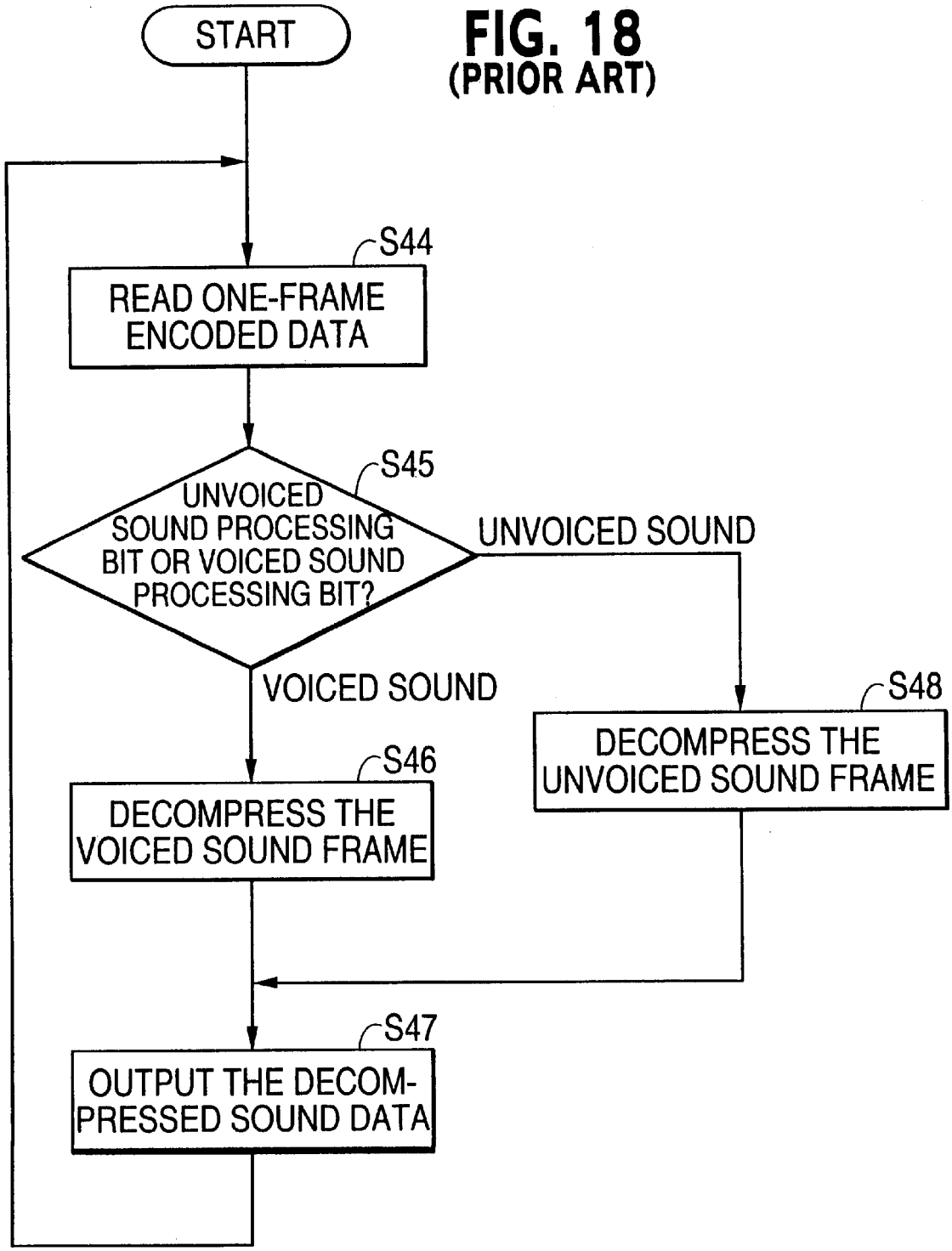
FIG. 18 (PRIOR ART)
FIG. 18 is a flowchart showing the flow of sound decompression processing in the conventional sound compression/decompression system.
Figure 19:
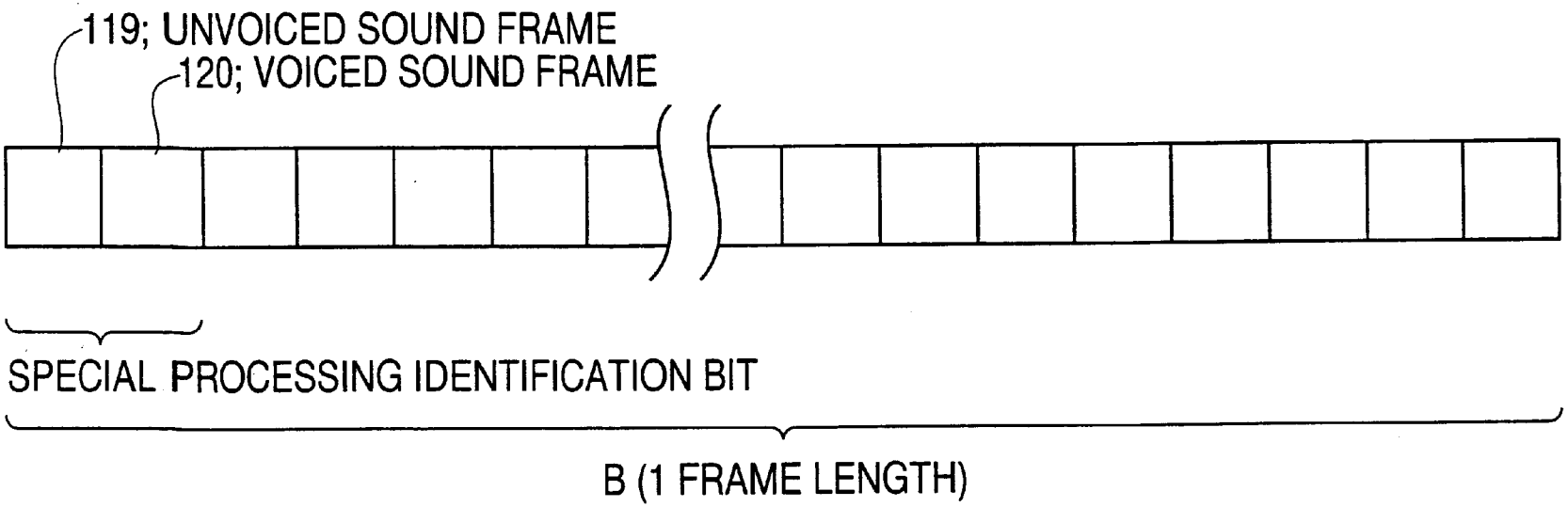
FIG. 19 (PRIOR ART)
FIG. 19 is a diagram showing a bit stream of encoded data used in a prior art.

To explain the above-described third preferred mode in more detail, a third embodiment of the present invention is described below. FIG. 12 is a diagram showing the configuration of the third embodiment of the present invention. FIG. 13 is a flowchart showing the flow of sound data compression processing that is performed in the third embodiment of the present invention. FIG. 14 is a flowchart showing the flow of sound data decompression processing that is performed in the third embodiment of the present invention. FIG. 15 is an overview of a bit stream for one-frame encoded data used in the third embodiment of the present invention.

In FIG. 12, number 86 refers to source sound data, number 87 refers to encoded data compressed by a sound compression processing module, and number 88 refers to decompressed sound data decompressed by a sound decompression processing module. Number 89 refers to the sound compression processing module, number 90 refers to source sound data reading means, number 91 refers to unvoiced state checking means, number 92 refers to index bit manipulation means, number 93 refers to index bit output means, number 94 refers to sound compression means according to the CELP method explained in the first preferred mode, and number 95 refers to encoded data output means. Number 96 refers to the sound decompression processing module, number 97 refers to encoded data reading means, number 98 refers to index bit checking means, number 99 refers to unvoiced data generating means, number 100 refers to sound decompression means according to the CELP method explained in the first preferred mode, number 101 refers to decompressed sound data output means, and number 102 refers to encoded data reading start address adjustment means.

The sound data compression/decompression system used in the third embodiment of the present invention assumes the unvoiced state as the special processing state. By referring to FIG. 13 and FIG. 14, the compression/decompression of unvoiced sounds with the use of the third embodiment of the present invention is described below. FIG. 15 shows a bit stream for one-frame encoded data used in the third embodiment, where N represents the index. In the third embodiment of the present invention, the value of '1111111', which is not generated during normal compression operation, is assigned as the value for an unvoiced frame.

In the description of the third embodiment of the present invention, it is assumed that sound data is entered in the sequence of a voiced frame→an unvoiced frame→and a voiced frame.

First, the source sound data reading means 90 reads one frame of source sound data into the sound compression processing module in step S24.

Then, in step S25, the unvoiced state checking means 91 checks if the entered frame is an unvoiced frame. Because the first frame is a voiced frame in this example, control is passed to step S28 where the sound compression means 94 compresses the sound data and, in step S29, the encoded data output means 95 outputs the encoded data.

Control goes back to step S24 to read the second frame of the source data. Control is passed to step S25 to check if the entered frame is a voiced frame or an unvoiced frame. Because the second frame is an unvoiced frame in this example, control is passed to step S26 where the index bit manipulation means 92 sets the index N bits of the bit stream, shown in FIG. 15, to '1111111' which is defined as unvoiced compression.

Then, control is passed to step S27 where the index bit output means 93 outputs only the index part, which was set to '1111111', as the encoded data.

Control goes back to step S24 again to read the third frame of the source sound data and, in step S25, the check is made to see if the frame is an unvoiced frame. Because the third frame is a voiced frame in this example, control is passed to step S28 where the sound data is compressed and, in step S29, the encoded data is output.

Next, the following describes how the sound data compressed in the sequence of a voiced frame, an unvoiced frame, and a voiced frame is decomposed.

First, the encoded data reading means 97 reads one frame of encoded data. In this case, the size of the encoded data that is read is equal to that of the encoded data of a voiced frame. That is, a part of the bit stream indicated by B in FIG. 15 is read.

Then, the index bit checking means 98 checks the value of the N-bit index. Because the first frame is a voiced frame, the N bits are not '1111111' and, therefore, control is passed to step S34 where the sound decompression means 100 decompresses the sound data. In step S35, the decompressed sound data output means 101 outputs the decompressed sound data. In step S36, the encoded data reading start address adjustment means 102 increments the input data pointer by B which is the number of bits of the bit stream.

Control goes back to step S30 to read the second frame of encoded data. Control is then passed to step S31. Because the second frame is an unvoiced frame and therefore the N bits are '1111111', control is passed to step S32. In step S32, the unvoiced data generating means 99 generates one frame of unvoiced signals as decompressed sound data and, in step S33, the encoded data reading start address adjustment means 102 increments the input data pointer by N which is the number of bits of the index. Control goes back to step S30 again, the encoded data is read, and control is passed to step S31. Because the third frame is a voiced frame in this example, control is passed to step S34 where the encoded data is decompressed. Then, in step S35, the input pointer is incremented by B which is the number of bits of the bit stream.

The first to third preferred modes of the present invention are described above with the CELP method as an example. The present invention is not limited to this method; it may be applied to a sound compression/decompression system which compresses and decompresses sounds on a frame basis. For example, the present invention may be applied to the APC (Adaptive Predictive Coding) method or the ATC (Adaptive Transform Coding) method, as described in the publication written by Furui ("Digital Sound Processing", Tokai University Publishing). At the same time, although the LSP coefficients are used as an index in the above description, other parameters such as GAIN parameters and POWER parameters may also be used.

In the description of the second embodiment of the present invention, the unvoiced frame number is used as the special processing information. Other information may also be used. For example, the background noise code-book switching information, which is added at unvoiced sound transmission time, may also be added to transmit information on a plurality of unvoiced sound states. This is described in "PSI-CELP based variable bit rate sound coding" by Oomuro, Noma and Moriya, in March, 1994 issue of "Japan Acoustic Society spring-term lecture paper collection in 1994".

As described above, the present invention has the following advantages.

The first advantage is that special-processing information may be transmitted without degrading the bit rate.

This is because special-processing information, which has been transmitted using additional special bits, is transmitted in the present invention as the value of a specified bit string within a frame. Transmitting special-processing information in this manner does not degrade the bit rate.

The second advantage is that, when the system transmits information at a constant bit rate, the parameters used for special processing may be transmitted at the same time.

The third advantage is that a variable bit-rate sound compression/decompression system may be built if no special-processing parameters are sent.

It should be noted that modification obvious in the art may be done without departing the gist and scope of the present invention as disclosed herein and claimed hereinbelow as appended.

What is claimed is:

1. A sound compression/decompression system which compresses and decompresses sounds, frame by frame, the system comprising:

a sound compression processing module which, for a first frame for which special processing is performed, sets to a special state an index within a bit stream to be transmitted by the first frame and transmits the first frame for which said special processing is performed, and which, for a second frame for which said special processing is not performed, does not change an index within a bit stream to be transmitted by the second frame and transmits the second frame for which said special processing is not performed; and a sound decompression processing module which references the index within said bit stream and performs said special processing for the first frame and does not perform said special processing for the second frame, wherein, for the first frame for which said special processing is performed, said sound compression processing module sets the index value within the bit stream transmitted by the first frame to a value not used during normal compression operation.

2. A sound compression/decompression system which compresses and decompresses sounds, frame by frame, the system comprising:

a sound compression processing module which, for a first frame for which special processing is performed, sets to a special state an index within a bit stream to be transmitted by the first frame, stores information necessary for the special processing into non-index bits, and transmits the first frame for which said special processing is performed, and which, for a second frame for which said special processing is not performed, does not change an index within a bit stream to be transmitted by the second frame and transmits the second frame for which said special processing is not performed; and a sound decompression processing module which references the index within said bit stream to identify that the special processing is performed for the first frame and that said special processing is not performed for the second frame, gets information necessary for said special processing for the first frame from the non-index bits within the bit stream, and performs said special processing on the first frame and does not perform said special processing for the second frame, wherein, for the first frame for which said special processing is performed, said sound compression processing module sets the index value within the bit stream transmitted by the first frame to a value not used during normal compression operation.

3. A sound compression/decompression system which compresses and decompresses sounds, frame by frame, the system comprising:

a sound compression processing module which, for a first frame for which special processing is performed, sets to a special state an index within a bit stream to be transmitted by the first frame and transmits only the index bits, and which, for a second frame for which said special processing is not performed, does not change an index within a bit stream to be transmitted by the second frame and transmits the second frame for which said special processing is not performed; and a sound decompression processing module which references the index within said bit stream to identify that said special processing is performed for the first frame and performs said special processing for the first frame, and which references the index within said bit stream to identify that said special processing is not performed for the second frame and does not perform said special processing for the second frame, wherein, for the first frame for which the special processing is performed, said sound compression module sets the index within the bit stream transmitted by the first frame to a value not used during normal compression operation.

4. A sound compression/decompression method of compressing and decompressing sounds, frame by frame, the method comprising:

performing sound compression processing in which, for a first frame for which special processing is performed, an index within a bit stream to be transmitted by the first frame is set to a special state and the first frame for which said special processing is performed is transmitted, and in which, for a second frame for which said special processing is not performed, an index within a bit stream to be transmitted by the second frame is not changed and the second frame for which said special processing is not performed is transmitted; and performing sound decompression processing in which the index within said bit stream of the first frame is referenced and said special processing is performed for the first frame, and in which the index within said bit stream of the second frame is referenced and said special processing is not performed for the second frame, wherein, for the first frame for which said special processing is performed, the index within the bit stream transmitted by the first frame is set to a special state by setting the index to a value not used during normal compression operation.

5. A sound compression/decompression method of compressing and decompressing sounds, frame by frame, the method comprising:

performing sound compression processing in which, for a first frame for which special processing is performed, an index within a bit stream to be transmitted by the first frame is set to a special state, information necessary for the special processing is stored into non-index bits, and the first frame for which said special processing is performed is transmitted, and in which, for a second frame for which said special processing is not performed, an index within a bit stream to be transmitted by the second frame is not changed and the second frame for which said special processing is not performed is transmitted; and performing sound decompression in which the index within said bit stream is referenced to identify that the special processing is performed for the first frame and that said special processing is not performed for the second frame, information necessary for said special processing for the first frame is obtained from the non-index bits within the bit stream, and said special processing is performed for the first frame, and in which said special processing is not performed for the second frame, wherein, for the first frame for which said special processing is performed, the index within the bit stream transmitted by the first frame is set to a special state by setting the index to a value not used during normal compression operation.

6. A sound compression/decompression method of compressing and decompressing sounds, frame by frame, the method comprising:

performing sound compression processing in which, for a first frame for which special processing is performed, an index within a bit stream to be transmitted by the first frame is set to a special state and only the index bits are transmitted, and in which, for a second frame for which said special processing is not performed, an index within a bit stream to be transmitted by the second frame is not changed and the second frame for which said special processing is not performed is transmitted; and performing sound decompression processing in which the index within said bit stream is referenced to identify that said special processing is performed for the first frame and said special processing is performed for the first frame, and in which said bit stream is referenced to identify that said special processing is not performed for the second frame and said special processing is not performed for the second frame, wherein, for the first frame for which the special processing is performed, the index within the bit stream transmitted by the first frame is set to a special state by setting the index to a value not used during normal compression operation.

7. A sound compression/decompression system which compresses and decompresses sounds, frame by frame, the system comprising:

a sound compression processing module which, for a first frame for which special processing is performed, sets to a special state an index within a bit stream to be transmitted by the first frame, stores information necessary for said special processing into non-index bits, and transmits the first frame for which said special processing is performed, and which, for a second frame for which said special processing is not performed, does not change an index within a bit stream to be transmitted by the second frame and transmits the second frame for which said special processing is not performed; and a sound decompression processing module which references the index within said bit stream to identify that said special processing is performed for the first frame and that said special processing is not performed for the second frame, gets information necessary for said special processing for the first frame from the non-index bits within the bit stream, and performs said special processing for the first frame and does not perform said special processing for the second frame, wherein the information necessary for said special processing for the first frame includes information corresponds to a number of consecutive frames of data that have been compressed into a single frame to be uncompressed by performing said special processing for the first frame.

8. A sound compression/decompression system which compresses and decompresses sounds, frame by frame, the system comprising:

a sound compression processing module which, for a first frame for which special processing is performed, sets to a special state an index within a bit stream to be transmitted by the first frame and transmits only the index bits by the first frame, and which, for a second frame for which said special processing is not performed, does not change an index within a bit stream to be transmitted by the second frame and transmits the second frame for which said special processing is not performed; and a sound decompression processing module which references the index within said bit stream to identify that said special processing is performed for the first frame and performs said special processing for the first frame, and which references the index within said bit stream to identify that said special processing is not performed for the second frame and does not perform said special processing for the second frame.

9. A sound compression/decompression system as defined in claim 8, wherein, for the first frame, the sound decompression processing module outputs unvoiced sound data that is not related to information in the first frame transmitted by the sound compression processing module.

* * * * *